United States Patent [19]

Bruce et al.

[11] Patent Number: 4,660,306

[45] Date of Patent: Apr. 28, 1987

[54] TRENCHER ATTACHMENT FOR HYDRAULIC EXCAVATORS

[75] Inventors: Robert J. Bruce; John K. Naypaver, both of New Castle, Pa.

[73] Assignee: Bruce & Merrilees Electric Co., New Castle, Pa.

[21] Appl. No.: 801,220

[22] Filed: Nov. 25, 1985

[51] Int. Cl.[4] ..... E02F 5/06

[52] U.S. Cl. ..... 37/86; 37/117.5

[58] Field of Search ..... 37/86, 87, 191 R, DIG. 3, 37/DIG. 12, DIG. 6, 117.5

[56] References Cited

U.S. PATENT DOCUMENTS

| | | | |
|---|---|---|---|
| 2,835,055 | 5/1958 | Hermes | 37/86 A |
| 3,044,194 | 7/1962 | Balkheimer | 37/86 |
| 3,178,838 | 4/1965 | Brown | 37/86 |
| 3,266,179 | 8/1966 | Golden | 37/86 |
| 3,398,471 | 8/1968 | Brown | 37/86 |
| 3,710,472 | 1/1973 | Gremillion et al. | 37/DIG. 3 |
| 3,754,341 | 8/1973 | Caldwell et al. | 37/86 |
| 3,834,049 | 9/1974 | Bond | 37/86 |
| 4,222,186 | 9/1980 | Molby | 37/86 |
| 4,327,508 | 5/1982 | Youngers | 37/86 |
| 4,480,955 | 11/1984 | Andrews et al. | 37/117.5 X |
| 4,497,608 | 2/1985 | Sheppard et al. | 37/DIG. 6 |
| 4,595,240 | 6/1986 | Pettersson | 37/117.5 X |

OTHER PUBLICATIONS

"The Golddigger", Model B46.

*Primary Examiner*—Edgar S. Burr
*Assistant Examiner*—Moshe I. Cohen
*Attorney, Agent, or Firm*—Harpman & Harpman

[57] ABSTRACT

A trencher attachment for a hydraulic excavator of the truck mounted type enables the excavator to be effectively used in performing trenching functions relative to the construction and maintenance of various underground installations. The trencher attachment and a trencher carried thereby on the free end of a telescopic boom of the excavator can be moved toward and away from the excavator, lifted and lowered, tilted and swung to any desired location where the trencher may be actuated by remote control from the excavator. The trencher attachment thereby enables a trenching operation to be performed in locations heretofore inaccessible to trenchers presently known in the art.

10 Claims, 5 Drawing Figures

TRENCHER ATTACHMENT FOR HYDRAULIC EXCAVATORS

BACKGROUND OF THE INVENTION

1. Field of the Invention

This invention relates to trenchers and an attachment including the trencher adjustably mounted on the extensible boom of a truck mounted excavator.

2. Description of the Prior Art

Trenching devices attached to various motor driven vehicles may be seen in U.S. Pat. Nos. 3,044,194, 3,266,179, 3,398,471 and 3,710,472.

In U.S. Pat. No. 3,044,194 and 3,266,179, tractors support position and operate trenchers.

In U.S. Pat. No. 3,044,194, the trencher is closely coupled to the tractor while in U.S. Pat. No. 3,266,179 a boom and boom extension support the trencher on the tractor.

In U.S. Pat. No. 3,710,472 a boom mounted on a truck carries a dipper stick which in turn has a trencher and a bucket affixed thereto.

In U.S. Pat. No. 3,398,471, a trencher and auger are mounted on a tractor.

The present invention relates to a trencher attachment which in addition to adjustably positioning a trencher supplies the motion necessary to actuate the trencher and a screw-type conveyor positioned transversely of the attachment for removing excavated material away from the excavation. More importantly, the trencher attachment of the present invention can be adjustably mounted on the end of a telescopically extensible boom of a truck mounted excavator such as for example the hydraulic excavator said under the trademark GRADALL manufactured by the Gradall Company of New Philidelphia, Ohio.

The trencher attachment of the present invention replaces the bucket normally used on the telescopically extensible boom of the GRADALL device.

The prior art references neither disclose or suggest the novel trencher attachment of the present invention.

SUMMARY OF THE INVENTION

A trencher attachment for hydraulic excavators is disclosed which is attachable in an adjustable manner to the free end of a telescopic boom of a truck mounted excavator or the like. The attachment incorporates a continuous chain trencher and a screw-type conveyor and a fluid motor for driving the same along with remotely actuated controls therefor. The trencher attachment in combination with the telescopic boom of the excavator enables the trencher attachment to continuously excavate a trench in heretofore inaccessible locations.

DESCRIPTION OF THE PREFERRED EMBODIMENT

Figure 1:
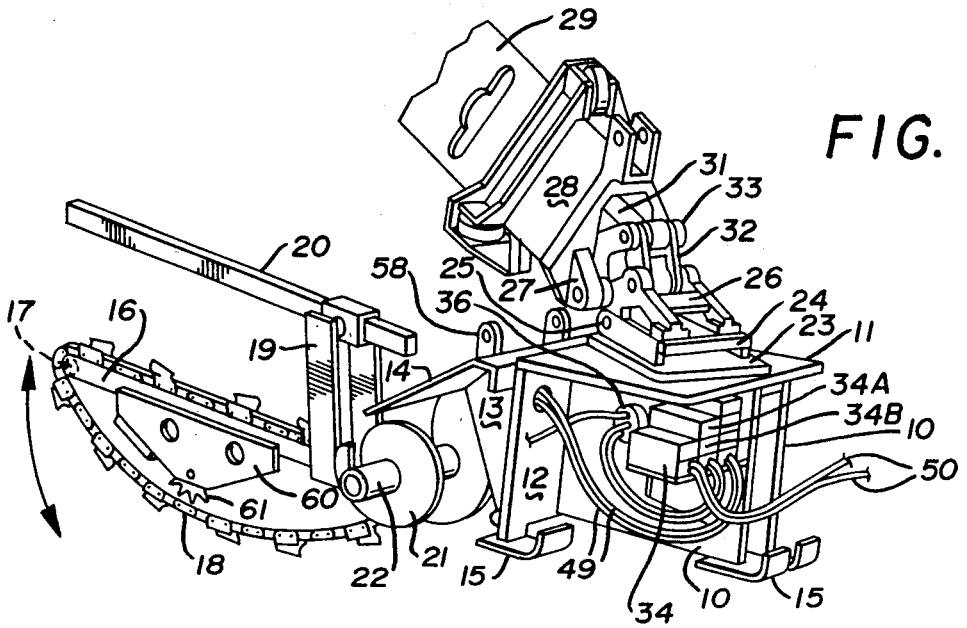
FIG. 1 is a perspective elevation of the trencher attachment positioned on a portion of a telescopic boom of a truck mounted excavator.

Hydraulic excavators used in earth moving operations are powered machines, frequently truck mounted for portability and which include a telescopically extendible boom carrying a bucket on the free end thereof. The telescopically extendable boom is capable of vertical movement, tilting motion, and is swingable in a circle based on its pivotal mounting on the truck or comparable supporting vehicle.

Trenchers, heretofore known in the art, include an elongated frame and means training a continuous chain outwardly and inwardly of the elongated frame, the chain having earth moving elements spaced therealong. Some trenchers have been provided with independent power means and others utilize power take-offs from other vehicles such as pickup trucks or tractors which are generally used in supporting and positioning the trenchers.

The present invention comprises an attachment frame having spaced vertical body members 10, a top portion 11, a transverse member 12 and three secondary vertically disposed frame members 13 extending outwardly from the transverse member 12. An angular secondary top portion and shield 14 is attached to the upper edges of the secondary frame members 13 and skids 15 are attached to the lower edges of the spaced vertical body members 10 and the transverse member 12.

Still referring to FIG. 1 of the drawings, it will be seen that a trencher frame 16 which is pivotally mounted to the attachment frame extends outwardly therefrom and is provided with an idler 17 at its outermost end over which a continuous digging chain 18 is trained. A pair of vertical supports 19 on the trencher frame 16 position a safety bar 20 as customary in the art. A screw type conveyor or auger 21 is formed about a transverse driven shaft 22 and the continous digging chain 18 is trained over a sprocket 42 thereon and the idler 17 as best seen in FIGS. 2 and 3 of the drawings and hereinafter described.

Figure 4:
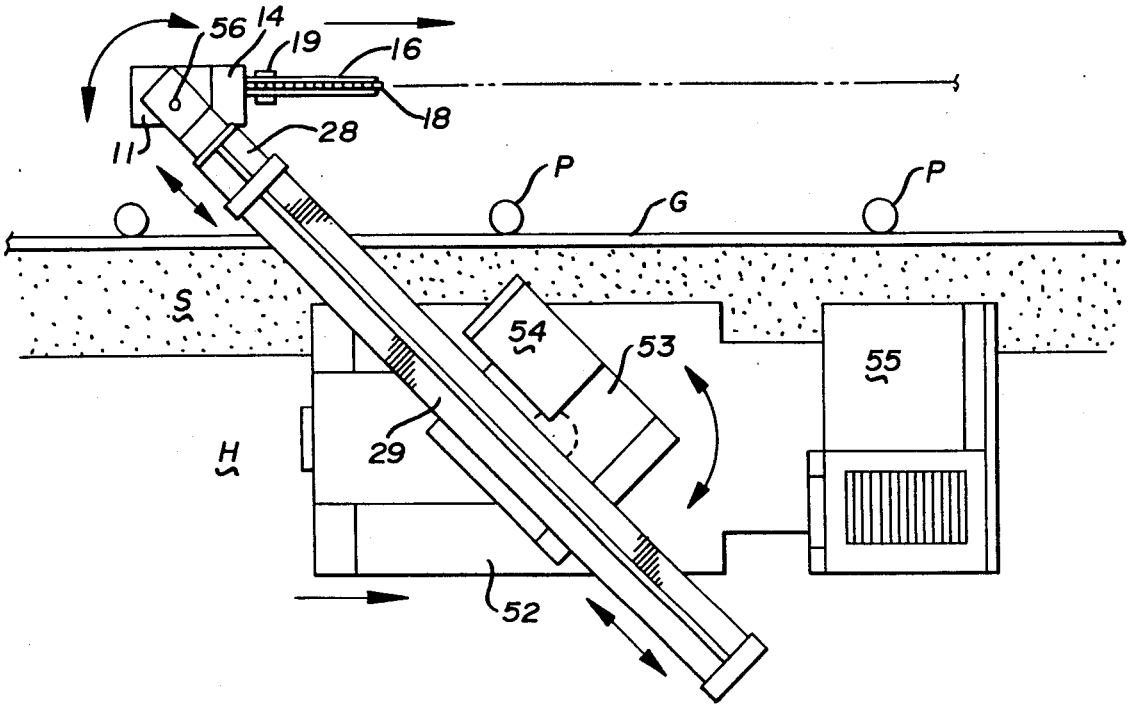
FIG. 4 is a top plan schematic elevation of a truck mounted excavator carrying the trencher attachment.
Figure 5:
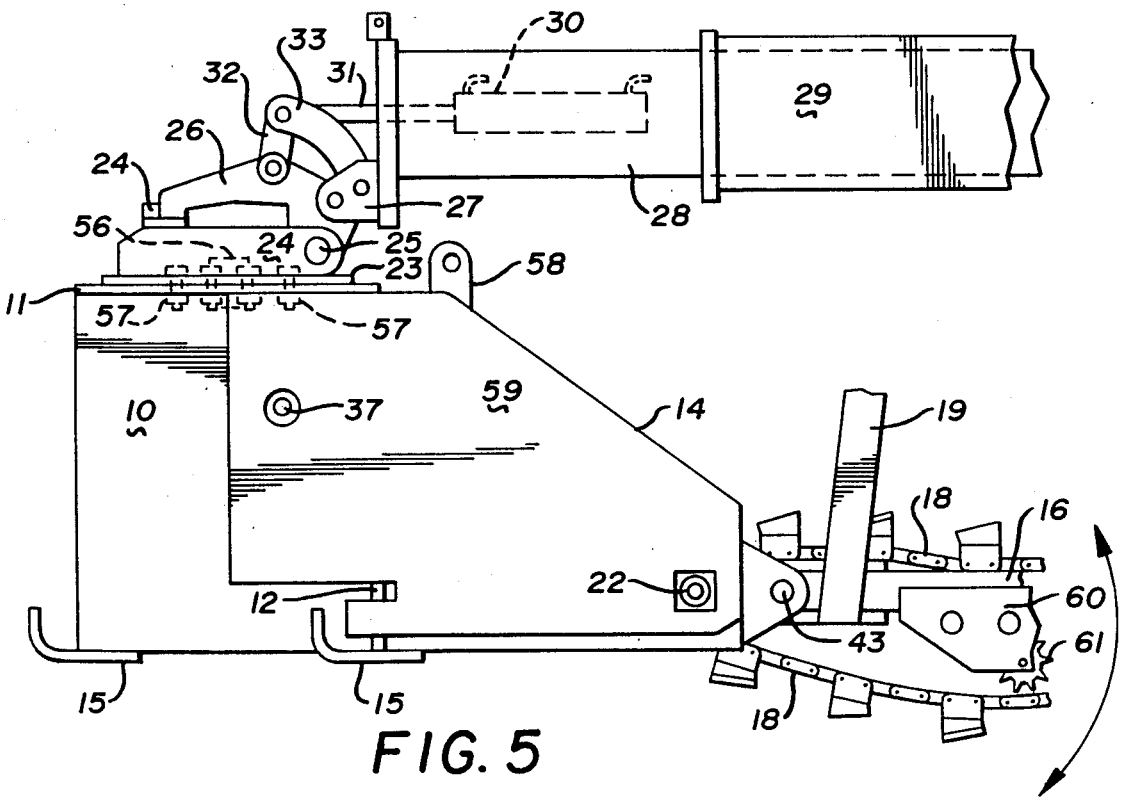
FIG. 5 is a side elevation of the trencher attachment and a portion of a telescopic boom supporting the same with parts broken away.

Still referring to FIG. 1 of the drawings, a pivot plate 23 is adjustably attached to the top 11 of the attachment frame by a pivot pin and a plurality of fasteners as best seen in FIG. 5 of the drawings and hereinafter described. The arrangement is such that the attachment frame and the trencher incorporated therein can be rotated relative to the pivot plate 23. A lifter frame 24 is attached to the pivot plate 23 and positions a transvers pin 25 to which a lifting device 26 is attached as best shown in FIG. 5 of the drawings and hereinafter described. The lifting device 26 is pivoted to an end frame 27 on the end of an inner member 28 of a telescopic boom 29 of the hydraulic excavator as seen in FIG. 4 of the drawings and hereinafter described. The telescopic boom 29 and the inner member 28 thereof mounts a piston and cylinder assembly 30, the piston rod 31 of which is pivotally connected by links 32 with the lifting device 26 hereinbefore described and guide links 33 pivoted to the frame 27 engage the pivot connecting the piston rod 31 and the links 32 so that tilting motion may be imparted to the attachment frame and the digging chain 18 and auger 21 thereof.

Still referring to FIG. 1 of the drawings, a plurality of remotely controlled fluid valves assemblies 34, 34A and 34B will be seen positioned on one of the frame members 10 and arranged to control fluid pressure in a plurality of fluid lines.

Figure 2:
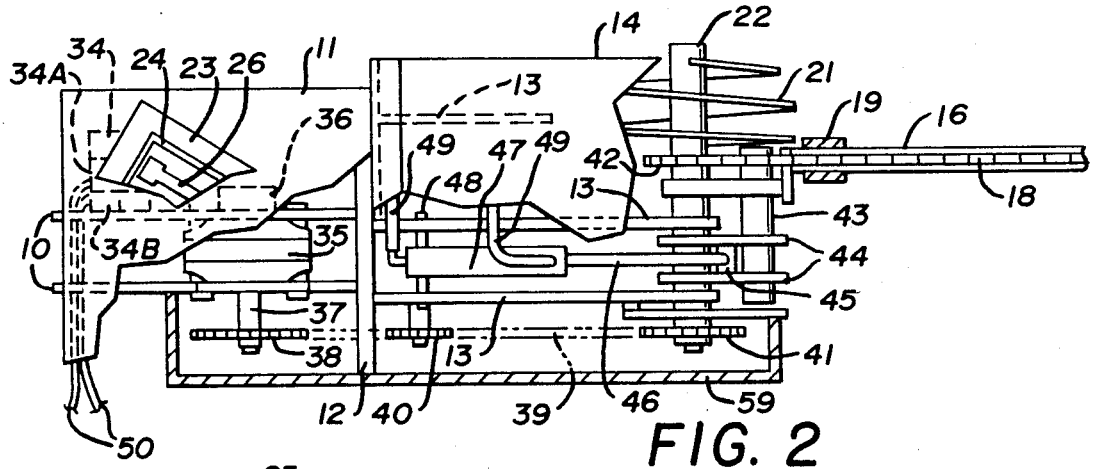
FIG. 2 is a top plan view of the trencher attachment with parts broken away and parts in cross section.
Figure 3:
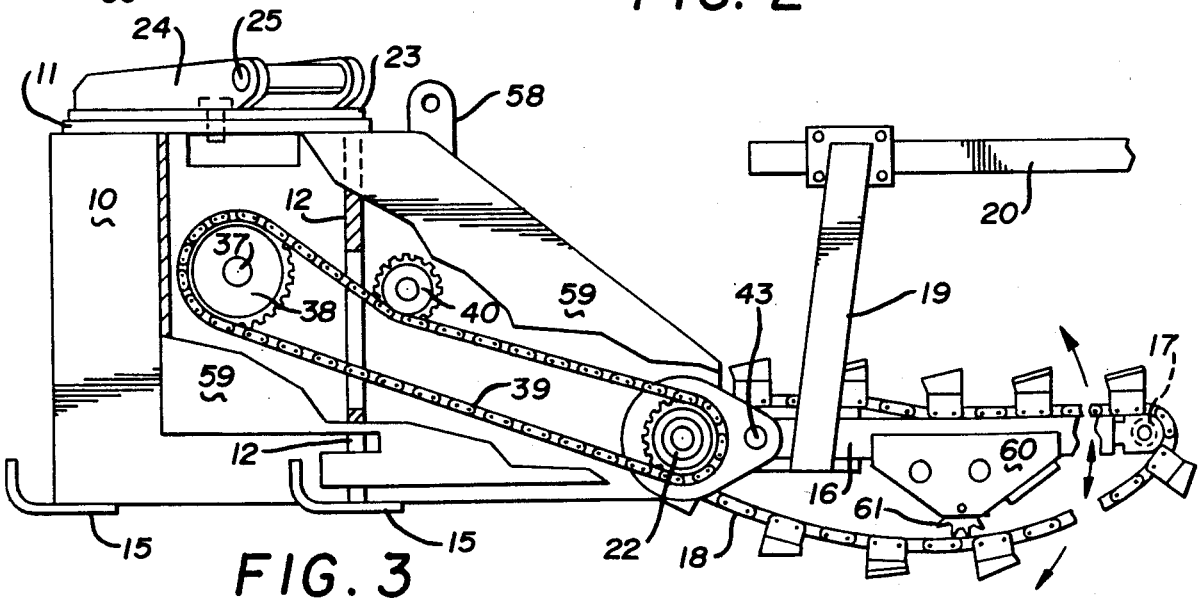
FIG. 3 is a side elevation of the trencher attachment with parts broken away.

By referring now to FIGS. 2 and 3 of the drawings, it will be seen that a fluid motor 35 is positioned between the spaced vertical body members 10 of the attachment frame with portions extending through apertures therein, one of the portions comprising a fluid line connecting block 36 and arranged in oppositely disposed relation to a drive shaft 37 on which a drive sprocket 38 is positioned. A drive chain 39 is trained over the drive sprocket 38, and engaged under an adjustable idler 40, and trained over a driven sprocket 41 attached to the transverse driver shaft 22 which carries the auger 21 hereinbefore described.

A secondary sprocket 42 attached to the transverse driven shaft 22 receives the digging chain 18.

Still referring to FIGS. 2 and 3 of the drawings, it will be seen that the trencher frame 16 which is pivotally attached at its innermost end to the transverse driven shaft 22 is also engaged by a lifting shaft 43 positioned on a pair of secondary arms 44 which are pivoted on the transverse driven shaft 22. A pivot pin 45 engages the secondary arms 44 and is connected to a piston rod 46 of a secondary piston and cylinder assembly 47 which is pivoted by a pivot pin 48 between the pair of frame members 13 of the attachment frame. The secondary piston and cylinder assembly 47 is connected by fluid lines 49 to one of the control valves 34, 3A and 34B which are in turn supplied by fluid pressure with fluid lines 50 which extend from the attachment frame along the boom 29 to a fluid power source on the truck mounted hydraulic excavator.

The operator of the truck mounted hydraulic excavator remotely controls valves 34, 34A and 34B and it will be seen that he can therefore control the operation of the fluid motor 35 which imparts rotary motion to the conveyor screw and auger 21 and the digging chain 18. The operator also controls the secondary piston and cylinder assembly 47 by which the trencher frame 16 and the digging chain 18 thereon are moved in a vertical plane in an arc based on the pivotal attachment of the trencher frame 16 on the transverse driven shaft 22 as hereinafter described. In addition to controlling these actions, the operator of the hydraulic excavator operates the piston and cylinder assembly 30 in the end of the telescopic boom so as to be able to tilt the attachment frame, its attached trencher and conveyor screw and auger in positioning the attachment frame and the attached trencher for operation in an otherwise inaccessible location. Additionally, the operator of the hydraulic excavator can extend and contract the telescopic boom 29, rotate the telescopic boom 29 on its longitudinal axis and, raise and lower it vertically and he can move it in a circle based on the truck mounted hydraulic excavator chassis 52 so as to position the attachment frame and trencher as desired.

By referring now to FIG. 4 of the drawings, a symbolic diagram comprising a top plan elevation may be seen including the chassis 52 of the truck on which the hydraulic excavator 53 is rotatably mounted. The operator's control cab 54 is rotatable along with the hydraulic excavator mechanism 53 and the mechanism supports and adjustably positions the telescopic boom 29 with its inner telescopic member 28 to which the top 10 of the attachment frame is adjustably attached.

In FIG. 4 of the drawings, the chassis 52 of the truck formed theron is illustrated in position on a highway H along the shoulder S thereof and movable in the manner of a conventional truck along the highway H as controlled by an operator in a cab 55. A guard rail G is illustrated as being supported on posts P and it will be seen that the trencher including the trencher frame 16 and the digging chain 18 are located beyond the guard rail G and may be positioned as illustrated or at any angle from horizontal conforming to the angle of the ground adjacent the guard rail. For example, when the angle inclines upwardly from the guard rail or from a position further spaced with respect thereto than illustrated, the trencher frame and the trencher are readily positioned for operation parallel with the highway at any elevation and regardless of the angle of inclination of the ground adjacent the highway in which the trench is to be formed.

In positioning the trencher frame and its trencher and earth moving auger at a desirable angle to the longitudinal axis of the telescopic boom 29, it is desirable and sometimes necessary to reposition the pivot plate 23 in relation to the top 11 of the attachment frame of the invention. In FIG. 5, a pivot pin 56 is illustrated as forming such a pivotal connection. In FIG. 5 of the drawings, the pivot pin 56 will be seen surrounded by a plurality of nut and bolt fasteners 57. The pivot pin 56 and the nut and bolt fasteners extend through the removably join the top 11 of the attachment frame and the pivot plate 23. The relative position of the attachment frame to the telescopic boom can be readily changed by temporarily supporting the attachment frame as by attaching a suitable lifting device to apertured tabs 58 thereon, temporarily removing the nut and bolt fasteners 57 and rotating the attachment frame to a desired position, reinserting the nut and bolt fasteners 57 and securing them. The apertures in which the nut and bolt fasteners 57 are removably positioned are formed in a circle, the center of which locates the aperture in which the pivot pin 56 is positioned.

Still referring to FIG. 5 of the drawings, it will be seen that the telescopic boom 29 and the lifting device 26 adjustably positioned on the end thereof as hereinbefore described can be temporarily removed from the lifting frame 24 on the pivot plate 23 thus simplifying the rotatable adjustment of the device as just described.

By referring now to FIGS. 2, 3 and 5 of the drawings, it will be seen that a closure panel 59 is illustrated in position on one side of the attachment frame of the device so as to protectively enclose the sprockets 38, 40 and 41 and the drive chain 39 trained thereover. In FIG. 2, the closure panel 59 is shown in cross section, in FIG. 3 it is shown with parts broken away, and in FIG. 5 it is shown in its entirety.

In FIGS. 1, 3 and 5, the trencher frame 16 is illustrated carrying spaced depending brackets 60 between which an idler sprocket 61 is rotatably positioned so as to extend outwardly therefrom and thus positioned so as to extend outwardly therefrom and thus positioned for engagement with the digging chain 18 when the same is under tension as in an earth removing operation.

It will thus be seen that a very efficient, highly maneuverable trenching attachment for a hydraulic excavator or any other motor driven excavator has been illustrated and described and that its use enables the rapid and economic trenching now increasingly used in connection with installing underground utilities including electrical and fluid conductors and the like.

Although but one embodiment of the present invention has been illustrated and described, it will be apparent to those skilled in the art that various changes and modifications may be made therein without departing from the spirit of the invention and having thus described our invention what we claim is:

1. A trencher attachment for a power driven excavator of the truck mounted type having a power supply system, a telescopic boom extending therefrom and manueverable with respect thereto, said trencher attachment comprising an attachment frame including vertically positioned horizontally spaced body members a rectangular top plate mounted on said body members, a transverse member mounted on said body members and a plurality of secondary frame members mounted on said transverse member, means on said top plate for connecting one end of said telescopic boom diagonally to said attachment frame rectangular top plate and rotating and tilting movement with respect to said telescoping boom, spaced drive and driven shafts journaled in said attachment frame body members and said attachment frame secondary members respectively, a drive chain connecting said drive and driven shafts, a trencher frame pivoted at one end to said driven shaft and an idler on the other end of said trencher frame, a drive sprocket on said driven, a a digging chain trained over said drive sprocket and said idler on said trencher frame, a motor on one of said vertically disposed body members of said attachment frame for moving said drive chain and means on said attachment frame for moving said trencher frame and digging chain in an arcuate path around said drive shaft in a vertical plane, said means comprising a pair of arms pivoted to and extending from said driven shaft, a lifting shaft on said arms engaging said trencher frame and a piston and cylinder assembly on said attachment frame connected to said pair of arms for moving said arms and said trencher frame in said arcuate path.

2. The trencher attachment set forth in claim 1 and wherein the power driven excavator is hydraulically driven, the power supply system is an hydraulic pressure supply system and the motor on said attachment frame is a fluid motor in communication with said hydraulic pressure supply system.

3. The trencher attachment set forth is claim 1 and wherein said driven shaft is rotatably positioned in said attachment frame and a screw type conveyor is formed spirally around a portion of said driven shaft for rotation therewith.

4. The trencher attachment set forth in claim 2 and wherein a plurality of fluid control valves are positioned in said attachment frame and fluid lines connect said fluid control valves and said fluid motor and said means for moving said trencher frame and digging chain in said arcuate path respectively and wherein secondary fluid lines connect with said fluid control valves and said hydraulic pressure supply system of said hydraulic excavator.

5. The trencher attachment set forth in claim 1 and wherein, said drive and driven shafts are positioned transversely of and rotatably engaged in one pair of said vertically positioned horizontally spaced body members.

6. The trencher attachment set forth in claim 1 and wherein said means on said attachment frame adjustably connecting the same to said one end of said telescopic boom includes a pivot plate movably positioned on said one end of said telescopic boom, a pivot pin centrally positioned through said pivot plate and said top plate of said attachment frame and a plurality of removable fasteners arranged around said pivot pin.

7. The trencher attachment set forth in claim 1 and wherein said means on said attachment frame adjustably connecting the same to said one end of said telescopic boom includes a pivot plate, a lifter frame on said pivot plate, a lifting device attached to said pivot plate; an end frame on said telescopic boom, a transverse pivot pin on said end frame, said lifting device pivoted to said transverse pivot pin on said end frame and means on said telescopic boom for moving said lifting device, lifter frame, pivot plate, attachment frame, trencher frame, and digging chain relative to said end frame on said telescopic boom in an arcuate path around said transverse pivot pin.

8. The trencher attachment set forth in claim 7 and wherein said means on said telescopic boom for moving said lifting device, lifter frame, pivot plate, attachment frame, trencher frame and digging chain comprises a source of reciprocal motion.

9. The combination of a power driven excavator of the truck mounted type having a power supply system and a telescopic boom extending therefrom and maneuverble with respect thereto and a trencher attachment comprising an attachment frame including vertically positioned horizontally spaced body members and a rectangular top plate mounted on said body members, a transverse member mounted on said body members and a plurality of secondary frame members mounted on said transverse member, means for connecting one end of said telescopic boom diagonally to said attachment frame rectangular top plate, a drive shaft and a driven shaft rotatably positioned in said attachment frame body members and said attachment frame secondary members respectively, and means on said attachment frame for rotating said drive shaft and said driven shaft, a trencher frame pivoted to said driven shaft, an idler sprocket on said trencher frame and a driven sprocket on said driven shaft, a digging chain trained over said driven sprocket and said idler sprocket on said trencher frame, and secondary means on said attachment frame for moving said trencher frame and digging chain in arcuate path around said driven shaft in a vertical plane and further means connecting said power supply system of said power driven excavator with said means for rotating said drive shaft and said secondary means for moving said trencher frame.

10. The trencher attachment set forth in claim 9 and wherein a screw type conveyor is formed spirally around a portion of said driven shaft for rotation therewith.

* * * * *